US006161713A

United States Patent [19]

Krich

[11] Patent Number: 6,161,713

[45] Date of Patent: Dec. 19, 2000

[54] BOTTLE WITH INTEGRATED GRIP PORTION

[75] Inventor: Jeffrey D. Krich, Orland Park, Ill.

[73] Assignee: Crown Cork & Seal Technologies Corporation, Alsip, Ill.

[21] Appl. No.: 09/206,651

[22] Filed: Dec. 7, 1998

[51] Int. Cl.[7] ..... B65D 1/42; B65D 23/10

[52] U.S. Cl. ..... 215/384; 215/382; 215/398; 220/669; 220/771

[58] Field of Search ..... 215/384, 382, 215/398; 220/675, 771, 669

[56] References Cited

U.S. PATENT DOCUMENTS

| | | | |
|---|---|---|---|
| D. 198,407 | 6/1964 | Busch | 215/384 X |
| D. 217,439 | 5/1970 | Platte | 215/384 X |
| D. 277,551 | 2/1985 | Kerr | 215/384 X |
| D. 278,978 | 5/1985 | Franchi et al. | 215/384 |
| D. 378,353 | 3/1997 | Emre et al. | D9/542 |
| D. 379,592 | 6/1997 | Doskoczynski | D9/542 |
| D. 387,279 | 12/1997 | Emre et al. | D9/542 |
| 1,636,174 | 7/1927 | Dolan et al. | 215/384 |
| 3,537,498 | 11/1970 | St. Amand | 215/384 X |
| 5,141,121 | 8/1992 | Brown et al. | 215/384 X |
| 5,178,289 | 1/1993 | Krishnakumar et al. | 215/382 |
| 5,224,614 | 7/1993 | Bono et al. | 215/100 A |
| 5,226,550 | 7/1993 | Mikolaitis et al. | 220/771 X |
| 5,472,105 | 12/1995 | Krishnakumar et al. | 220/675 X |
| 5,598,941 | 2/1997 | Semersky et al. | 215/384 |
| 5,704,503 | 1/1998 | Krishnakumar et al. | 215/384 X |
| 5,758,790 | 6/1998 | Ewing, Jr. | 215/384 |

OTHER PUBLICATIONS

Color photograph of 48oz. Mazola® Canola Oil bottle (Date Unknown).

Color photograph of 48oz Dominick's® Corn Oil bottle (Date Unknown).

Color photograph of 48oz unlabeled Oil bottle (Date Unknown).

*Primary Examiner*—Sue A. Weaver

*Attorney, Agent, or Firm*—Woodcock Washburn Kurtz Mackiewicz & Norris LLP

[57] ABSTRACT

A bottle for storing and dispensing contents comprises a grip portion for improving a user's grip on the bottle. The grip portion is situated on a side of the bottle and extends at least partially along the height of the bottle. The grip portion comprises a recessed panel having a concave shape, formed in the first side of the bottle and adapted to receive the user's fingers. In addition, the grip portion further comprises a grip panel situated on the recessed panel and comprising a plurality of ribs projecting radially outward from the recessed panel. The ribs are oriented substantially vertically to improve the vertical strength of the bottle in the area of the grip portion and spaced-apart so as to form depressions therebetween to receive the user's fingers.

7 Claims, 4 Drawing Sheets

BOTTLE WITH INTEGRATED GRIP PORTION

FIELD OF THE INVENTION

The present invention relates to bottles for storing and dispensing fluid, foodstuffs and other items, and more particularly to grip portions for such bottles.

BACKGROUND OF THE INVENTION

Bottles for storing and dispensing fluid and foodstuffs are well known. Most commonly, such bottles are blow-molded plastic containers. Such bottles are often used to contain fluids such as edible oils. Because such bottles are typically used repeatedly before their contents are consumed, they often have grip portions so that consumers can move the bottles to and from the kitchen cabinet or refrigerator with a sure grip.

Prior art grip portions provide improved grips over conventional bottle designs. These grip portions, however, often do not provide a comfortable grip that is easy to use. It is, therefore, also desirable to provide a grip portion for a bottle that is ergonomically designed and easier to use than conventional grip portions.

A typical prior art bottle having a grip portion is disclosed and described in U.S. Pat. No. 5,224,614, assigned to The Procter & Gamble Co. The bottle shown in this patent has a grip portion comprising a recessed portion of a typical bottle shape. In this way, the grip portion provides a thinner area that is easier for a user to grip. The grip portion, however, is weaker than the remainder of the bottle in terms of its ability to withstand vertical loading. Vertical strength is important because such bottles typically are stacked on top of each other, e.g., during shipping or storage. It is, therefore, desirable to provide a grip portion for a bottle that has as much vertical strength as the rest of the bottle.

SUMMARY OF THE INVENTION

A bottle for storing and dispensing contents comprises at least a first grip portion for improving a user's grip on the bottle. The first grip portion is situated on a first side of the bottle and extends at least partially along the height of the bottle. The first grip portion comprises a recessed panel formed in the first side of the bottle and adapted to receive the user's fingers. In addition, the recessed panel has a concave shape from the perspective of a location outside the bottle. Preferably, there are two grip portions on the bottle, one on each of two opposing sides of the bottle.

In a preferred embodiment, the first grip portion further comprises at least a first grip panel situated on the recessed panel and comprising at least a first rib projecting radially outward from the recessed panel. The rib is oriented substantially vertically to at least partially aid in improving the vertical strength of the bottle in the area of the grip portion. Preferably, the first grip panel further comprises second, third and fourth substantially vertically-extending ribs spaced-apart so as to form depressions between the ribs to receive the user's fingers.

In another preferred embodiment of the bottle, in which two adjacent sides are oriented at approximately 90 degrees to each other, the bottle further comprises a first corner area extending along the height of the bottle where the grip portion extends and forming a generally smooth transition area between the two adjacent sides. The first corner area has an arcuate cross section comprising a first radius of curvature and a second radius of curvature, wherein the first radius of curvature is larger than the second radius of curvature.

DETAILED DESCRIPTION OF THE PREFERRED EMBODIMENTS

Figure 1:
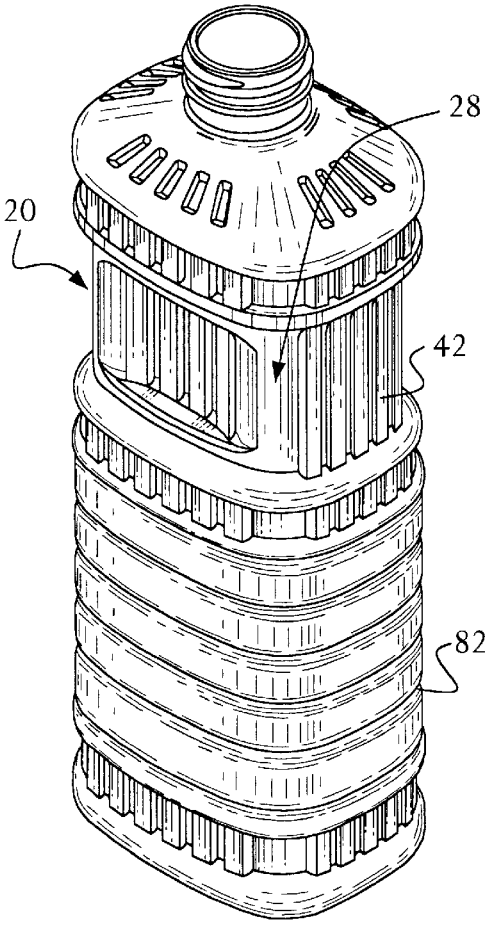
FIG. 1 a top isometric view of a bottle having a grip portion of the present invention.
Figure 2:
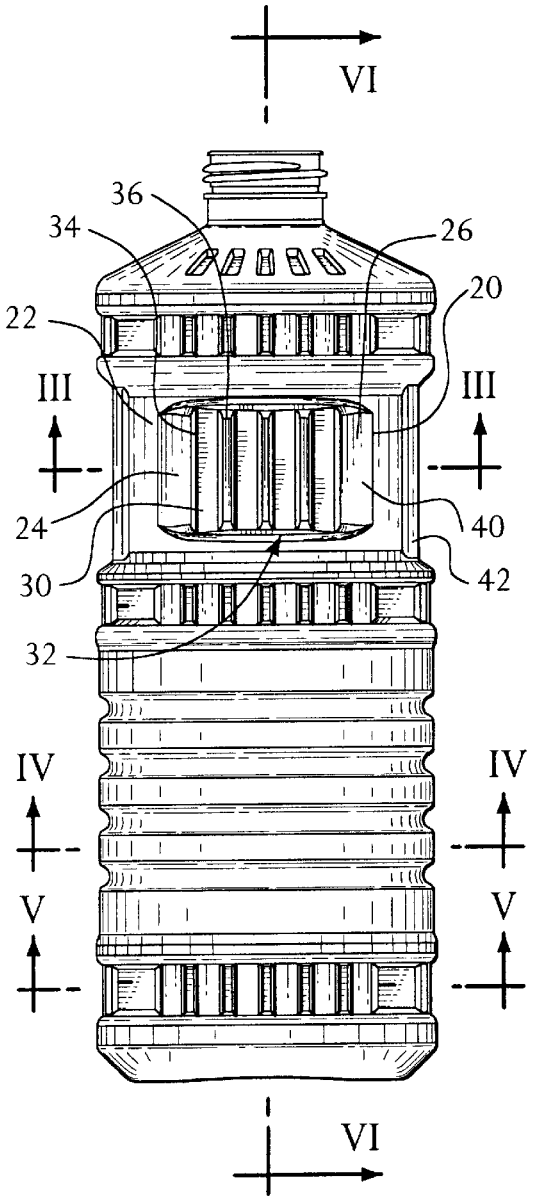
FIG. 2 is a front view of the bottle of FIG. 2.

The purpose of the present invention is to provide a grip portion for a bottle that is ergonomically designed, easier to use than conventional grip portions, and has at least as much vertical strength as the rest of the bottle. FIG. 1 shows a top isometric view of a bottle of the present invention having a grip portion 20 and FIG. 2 shows a front view of the bottle of FIG. 1. Preferably, there is one grip portion 20 on each of two sides of a bottle. The bottle of FIG. 1 has four sides, but solely for convenience and illustrative purposes, the sides having a grip portion 20 are referred to as the front and back sides. Each grip portion 20 preferably comprises a grip panel 32 having four rectangularly-shaped vertical ribs 30 and one substantially rectangularly-shaped window panel 40 within which the vertical ribs 30 are situated.

Each vertical rib 30 is a substantially rectangular projection situated in a vertical orientation. The vertical ribs 30 project from the rectangular panel 40, which itself is recessed from the front side surface 22 of the bottle at the grip portion 20. Preferably, each rib 30 has a depth (amount it projects from the rectangular panel 40) between approximately 0.03 and approximately 0.1 inch, and more preferably approximately 0.05 inch. In addition, the vertical ribs 30 are spaced-apart, resulting in depressions 36 between adjacent ribs 30.

Figure 3:
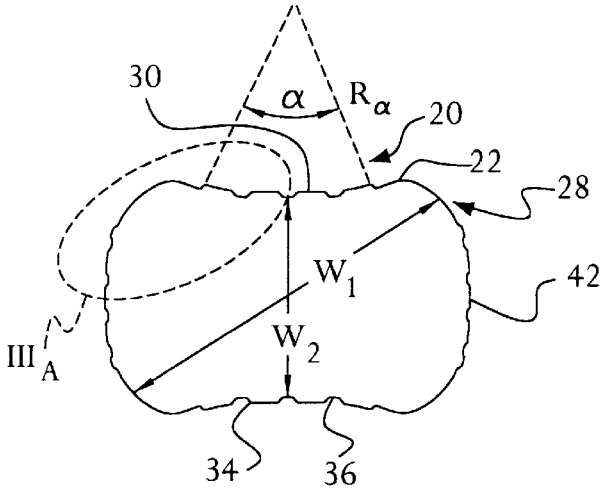
FIG. 3 is a cross-sectional view of the bottle of FIG. 2 along line III—III.
Figure 4:
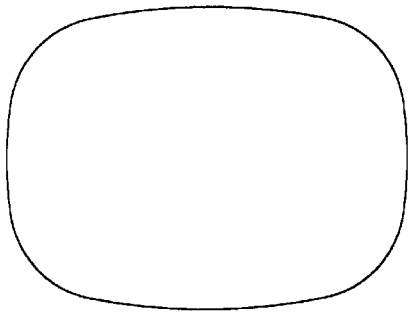
FIG. 4 is a cross-sectional view of the bottle of FIG. 2 along line IV—IV.
Figure 5:
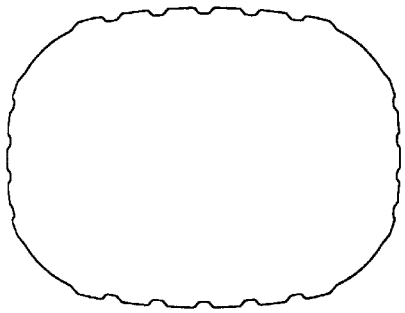
FIG. 5 is a cross-sectional view of the bottle of FIG. 2 along line V—V.
Figure 6:
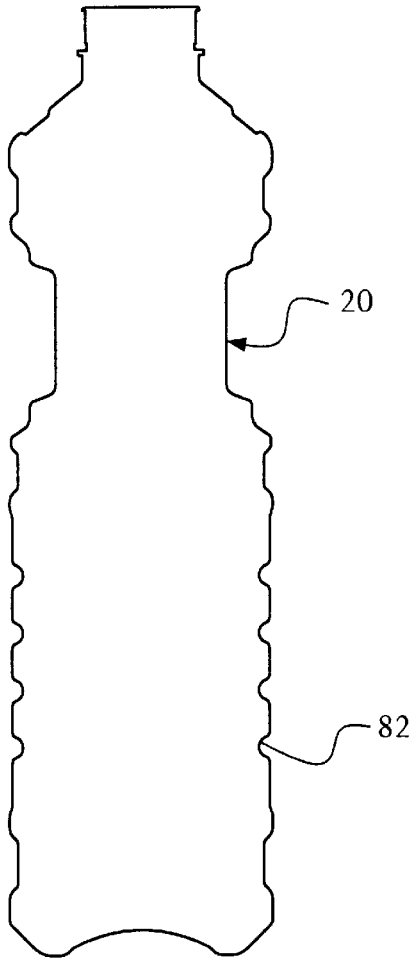
FIG. 6 is a longitudinal cross-sectional view of the bottle of FIG. 2 along line VI—VI.

FIG. 3 shows a cross-sectional view of the bottle of FIG. 2 along line III—III, FIG. 4 shows a cross-sectional view of the bottle of FIG. 2 along line IV—IV, and FIG. 5 shows a cross-sectional view of the bottle of FIG. 2 along line V—V. FIG. 6 shows a longitudinal cross-sectional view of the bottle of FIG. 2 along line VI—VI, FIG. 7 shows a side view of the bottle of FIG. 2 and FIG. 8 shows a longitudinal cross-sectional view of the bottle of FIG. 7 along line VIII—VIII.

Figure 7:
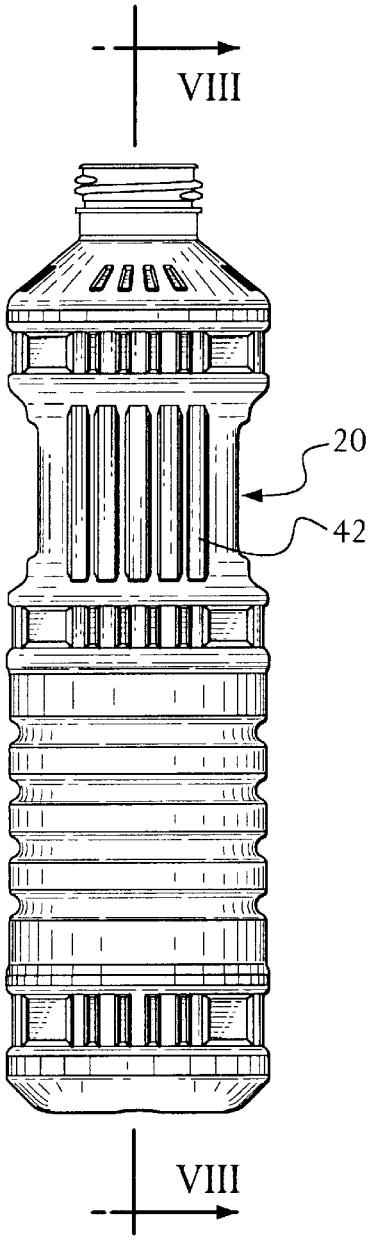
FIG. 7 is a side view of the bottle of FIG. 2.
Figure 8:
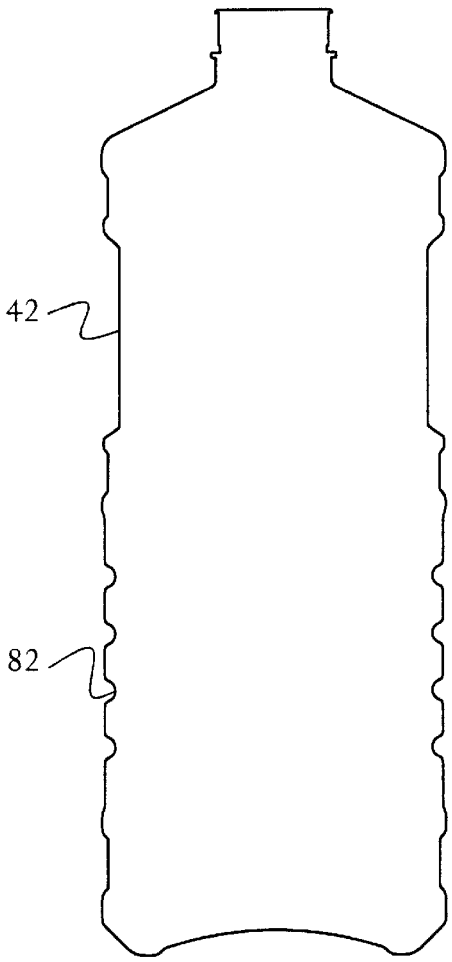
FIG. 8 is a longitudinal cross-sectional view of the bottle of FIG. 7 along line VIII—VIII.

As shown in FIG. 7, the grip portion 20 is recessed from the front and back sides of the bottle. As evident from FIGS. 1, 3 and 6, the grip portion 20 is recessed to a greater extent in the center of the bottle sides than near the corner areas 28, where the sides meet the front and back sides of the bottle. Preferably, the grip portion 20 is a curved recessed area of an arc having a radius of curvature so that the grip portion 20 is concave from outside the bottle looking in. Preferably, as shown in FIG. 3, the grip portion 20 has a radius of curvature $R_\alpha$ between approximately 1.5 and approximately 2.0 inches, more preferably between approximately 1.7 inches and approximately 1.8 inches, and spans an arc a of approximately 10 to approximately 60 degrees, more preferably between approximately 25 degrees and approximately 45, and most preferably approximately 30 degrees.

As shown in FIGS. 1, 3, 4 and 5, the bottle of the present invention has no sharp, well-defined corners between sides and front or back of the bottle. The bottle also has no vertically-extending ribs on any of these corner areas 28. In particular, there are no vertically-extending ribs 30 on the corner areas 28. The absence of vertical ribs 30, or any other grip or structural features on the corner areas 28 results in generally smooth corner area 28 that facilitates gripping by allowing a user to more easily place their hand on and remove their hand from the grip portion 20.

The corner areas 28 serve as smooth transition areas between the front and back sides on which the grip portions 20 are situated and the other sides of the bottle. The smooth corner areas 28 also aid in manufacturing the bottles of the present invention because it is easier to blow mold the corner areas 28 of the present invention than sharp, well-defined corners.

Figure 3A:
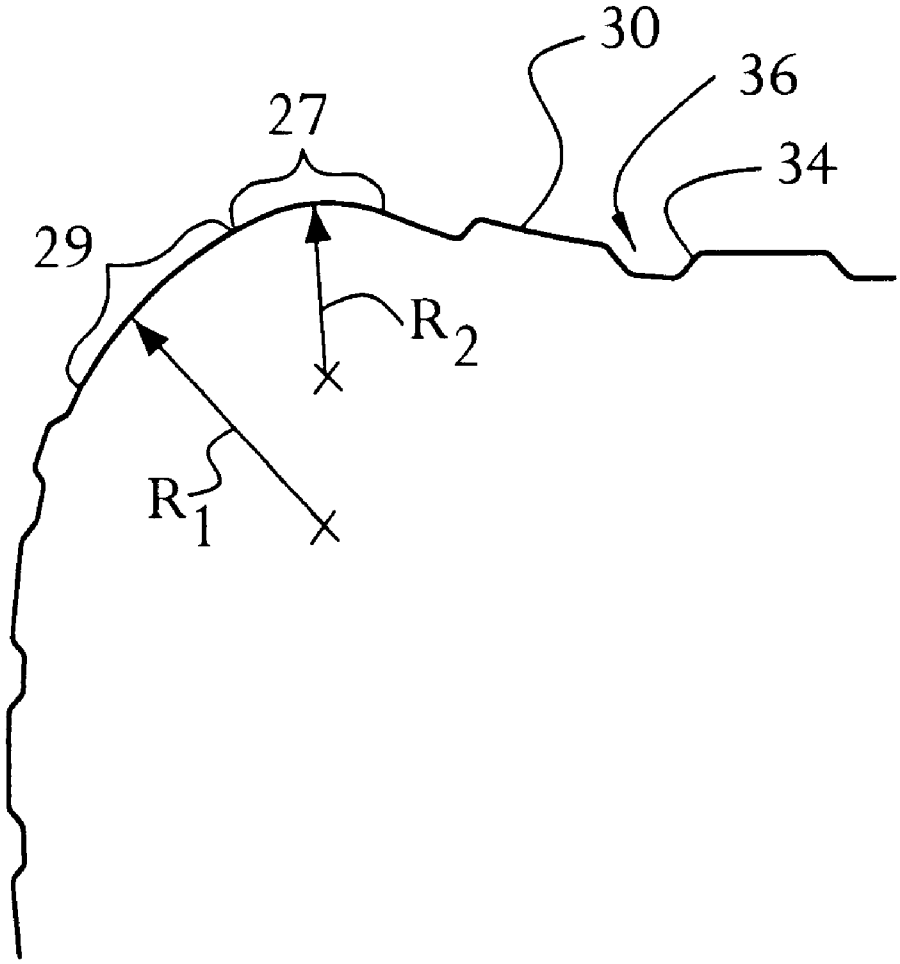
FIG. 3A shows an enlarged view of cut-away section IIIA of the cross section of FIG. 3.

FIG. 3A shows an enlarged view of a cut-away section IIIA of the cross section of FIG. 3. Preferably, the cross section of each corner area 28 of the bottle of the present invention comprise two arcs 29 and 27 of different curvature. The first arc 29 has a radius of curvature R, which is larger than the radius R2 of the second arc 27. Arc 29 is tangent to the side surface of the bottle and arc 27 is tangent to the front (or back) side surface of the bottle. In addition, the arcs 29 and 27 are tangent to each other at the point of intersection. Thus, the arcs 29 and 27 achieve a smooth transition between the sides of the bottle and the front and back sides of the bottle having the grip portions 20. As with typical prior art bottles, the sides of the bottle of the present invention are oriented at approximately 90 degree angles to the front and back sides of the bottle having the grip portions 20 so as to form a generally rectangular cross section, as shown in FIG. 4 and 5.

The vertical ribs 30 also aid in facilitating a user's grip on the bottle by providing ridges 34 (the edges 34 of the ribs 30 themselves) to prevent a user's fingers from slipping along the grip portion 20. The distance between vertical ribs 30 provide the depressions 36 between the ridges 34 that receive a user's fingers. Consequently, the grip portions 20 are easier to use than conventional grip portions. Preferably, the distance between vertical ribs 30 is between approximately 0.05 and approximately 0.15 inch, and more preferably approximately 0.10 inch.

The ribs 30 also allow for the grip portions 20 to have as much vertical strength as the rest of the bottle. The vertical ribs 30 serve as grip panels and also provide the much needed vertical strength to the grip portions 20 themselves. The concave grip portions 20 allow the width $w_1$ of the bottle across the corner area 28 to be much larger than the width $w_2$ in the center of the grip panels 20, providing for added strength and support in the corner areas 28, while still providing the narrower center area for a user to grip. In addition, the curved nature of the grip portions 20 contributes to the improved ergonomic design of the bottle of present invention. This area at the center of the grip portions 20 is where a user's thumb and fingers will apply the most pressure when gripping the bottle.

As shown in FIGS. 1, 2, 3 and 7, the grip portions 20 of preferred bottle of the present invention also have vertical ribs 42 on the sides of the bottle. These ribs 42 are similar to ribs 30, but project from the sides of the bottle instead of from a recessed panel. These vertical ribs 42 also help contribute to the vertical strength of the grip portion 20 as well as the bottle as a whole. As shown in FIG. 2, line VII represents a vertical plane that intersects the middle of the grip portion 20, yielding first and second ends 24 and 26, respectively, so that there are the same number of ribs on the first end 24 that there are on the second end 26.

In addition, as shown in FIGS. 1, 2, 6, 7 and 8, the preferred bottle of the present invention also has circumferentially-extending horizontal ridges, separated by arc-shaped depressions 82 that span the circumference or outer surface of the bottle. These horizontal ridges and depressions 82 provide axial (vertical) and radial strength and rigidity.

The present invention is further disclosed in commonly assigned design applications having Ser. No. 29/097,418, filed on Dec. 7, 1998, entitled "Bottle with Integrated Grip Portion"; and Ser. No. 29/097,417, filed on Dec. 7, 1998, entitled "Bottle with Integrated Grip Portion", each of which is hereby incorporated by reference herein in its entirety.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

What is claimed is:

1. A bottle for storing and dispensing contents, the bottle having a height and comprising:

at least a first side; and at least a first grip portion for improving a user's grip on the bottle, the first grip portion situated on the first side of the bottle and extending at least partially along the height of the bottle, the first grip portion comprising:

a recessed panel formed in the first side of the bottle and adapted to receive the user's fingers, said recessed panel having a concave shape from the perspective of a location outside the bottle and said recessed panel having a radius of curvature between approximately 1.5 and approximately 2.0 inches.

2. A bottle for storing and dispensing contents, the bottle having a height and comprising:

at least a first side; and at least a first grip portion for improving a user's grip on the bottle, the first grip portion situated on the first side of the bottle and extending at least partially along the height of the bottle, the first grip portion comprising:

a recessed panel formed in the first side of the bottle and adapted to receive the user's fingers, said recessed panel having a concave shape from the perspective of a location outside the bottle and said recessed panel having a radius of curvature between approximately 1.7 and approximately 1.8 inches.

3. The bottle of claim 2, wherein the recessed panel spans an arc of approximately 30 degrees.

4. A bottle for storing and dispensing contents, the bottle having a front, a rear, a height and comprising:

a first side, and a second side connected to said first side and oriented approximately 90 degrees from said first side;

at least one grip portion for improving a user's grip on the bottle, the first grip portion centered on the first side of the bottle such that the bottle can be gripped at the grip portion from the rear as easily it can be gripped from the front, and extending at least partially along the height of the bottle, the first grip portion comprising:

a recessed panel formed in the first side of the bottle and adapted to receive the user's fingers; and a first corner area extending along the height of the bottle where said grip portion extends, said first corner area being a generally smooth transition area from said first side to said second side, said first corner area having an arcuate cross section comprising a first radius of curvature and a second radius of curvature, said first radius of curvature being larger than said second radius of curvature.

5. A bottle for storing and dispensing contents, the bottle having a front, a rear, a height and comprising:

at least a first side; and at least a first grip portion for improving a user's grip on the bottle, situated on the first side of the bottle and extending at least partially along the height of the bottle, the first grip portion being centered on the first side of the bottle such that the bottle can be gripped at the grip portion from the rear as easily it can be gripped from the front, the first grip portion having first and second ends separated by a vertical plane intersecting the first grip portion at a middle of the first grip portion, the first grip portion comprising:

a recessed panel formed in the first side of the bottle and adapted to receive the user's fingers, said recessed panel having a concave shape from the perspective of a location outside the bottle; and at least a first grip panel situated on the recessed panel and comprising at least a first rib projecting radially outward from the recessed panel, said first rib oriented substantially vertically to at least partially aid in improving the vertical strength of the bottle in the area of the grip portion, wherein there are the same number of ribs on the first and second ends of said grip portion, wherein the recessed panel has a radius of curvature between approximately 1.5 and approximately 2.0 inches.

6. The bottle of claim 5, wherein the recessed panel has a radius of curvature between approximately 1.7 inches and approximately 1.8 inches.

7. The bottle of claim 5, wherein the recessed panel has a radius of curvature between approximately 1.7 inches and approximately 1.8 inches and spans an arc of approximately 30 degrees.

* * * * *

UNITED STATES PATENT AND TRADEMARK OFFICE

CERTIFICATE OF CORRECTION

PATENT NO. : 6,161,713
DATED : December 19, 2000
INVENTOR(S) : Jeffrey D. Krich

It is certified that error appears in the above-identified patent and that said Letters Patent is hereby corrected as shown below:

Title page,
Item [56], References Cited, please insert the following reference:

-- FOREIGN PATENT DOCUMENTS
430,203 6/1935 Great Britain Stevenson 215/384 --.

Signed and Sealed this

Twelfth Day of November, 2002

*Attest:*

*Attesting Officer*

JAMES E. ROGAN
*Director of the United States Patent and Trademark Office*